US006161631A

United States Patent [19]

Kennedy et al.

[11] Patent Number: 6,161,631

[45] Date of Patent: Dec. 19, 2000

[54] ENVIRONMENTALLY FRIENDLY HORIZONTAL BORING SYSTEM

[76] Inventors: James Kennedy, 702 Random Rd. N., Gramby, Mo. 64844; Steven J. Kennedy, P.O. Box 1277, Golden, Mo. 65658; Michael Kennedy, P.O. Box 461, Wheaton, Mo. 64874; Martin Kennedy, 304 Madison St., Pierce City, Mo. 65723

[21] Appl. No.: 09/128,888

[22] Filed: Aug. 4, 1998

[51] Int. Cl.[7] ..... E21B 7/20; E21B 4/14; E21B 10/38; E21B 10/44; B23B 45/16

[52] U.S. Cl. ..... 175/171; 175/296; 175/394; 173/135

[58] Field of Search ..... 173/4, 135, 206, 173/19, 15, 17; 175/62, 171, 296, 394, 395, 325.5, 415, 102, 122

[56] References Cited

U.S. PATENT DOCUMENTS

| | | | |
|---|---|---|---|
| 3,232,360 | 2/1966 | Dickinson | 175/62 |
| 4,928,775 | 5/1990 | Lee | 175/19 |
| 5,311,948 | 5/1994 | Kimberlin | 173/17 |
| 5,316,092 | 5/1994 | Ilomaki | 175/62 |
| 5,386,878 | 2/1995 | Rowekamp | 175/62 |
| 5,707,176 | 1/1998 | Okubo | 175/171 |
| 5,778,988 | 7/1998 | Ilomaki | 173/4 |
| 5,918,687 | 7/1999 | Prater, Jr. et al. | 173/206 |

*Primary Examiner*—Brian L. Johnson
*Assistant Examiner*—Joselynn Y. Sliteris
*Attorney, Agent, or Firm*—Lathrop & Gage, L.C.; Joseph L. Johnson; William A. Rudy

[57] ABSTRACT

A system for drilling a horizontal bore through frangible material includes a barrel mechanism containing a automatically reciprocating piston mechanism for automatically delivering hammering blows to a bit for chipping away the frangible material, a fluid distributor for directing fluid to and exhausting pressurized fluid from the piston mechanism without exposing the wall of the bore being created to fluid pressure greater than ambient atmospheric pressure, a spline/flute arrangement for causing the bit to rotate with the barrel mechanism, a motor and swivel mounted on a driven platform mounted on a supporting frame for urging the bit against the frangible material and for supplying the pressurized fluid, a pushing mechanism for non-rotatingly and simultaneously installing casing joints as various components of the system is rotatingly drilling the bore, an augering arrangement for, in conjunction with the casing joints, removing the drilling debris, and drill/auger stem sections for extending the drilling and augering capability of the system as the drilling progresses.

13 Claims, 2 Drawing Sheets

ENVIRONMENTALLY FRIENDLY HORIZONTAL BORING SYSTEM

BACKGROUND OF THE INVENTION

1. Field of the Invention

This invention relates to drilling generally horizontal bores through frangible material beneath surface structure, such as roadways for example.

2. Description of the Related Art

Drilling through frangible material under roadways or other surface structure is usually effected by a percussion tool which progressively drills into the earth. The percussion tool is generally threadingly connected by means of a sub assembly or adapted member to the end of a distal-most section of a drill stem. As the tool progresses into the hole, additional sections of the drill stem are coupled to the end of the last or proximal-most drill stem section in string-like fashion. Each stem of prior art equipment generally includes either a central passage which allows pressurized working fluid to be supplied to the sub-assembly which, in turn, serves to direct the pressurized working fluid to the working chamber of the percussion tool or hammer, or multiple passages to supply working fluid to the working chamber and another passage to provide relatively incompressible "mud" to the proximity of the working area to flush debris away from the working area.

In the former type of arrangements, the air pressure is released from the drill bit inside the hole and forced, together with the cuttings and any other debris in the hole, including water, upward into the annular space between the drill stem and the wall of the hole and out into the atmosphere. In this way, the hole is continually flushed and kept relatively clean to enable the surface being drilled to be broken up by the pneumatic action of a reciprocating bit. If the escape route for the released pressurized fluid should become blocked, such as by water mixed with debris for example, substantial pressures even with compressible fluids may quickly build up underground with the potential to bulge and damage road surfaces for example.

A primary difference with the latter type of prior art arrangement is that pieces of rock or cuttings cut by the drill bit are removed from the hole by drilling fluid or mud. The drilling mud is circulated by mud pumps through the center of the drill pipe, out through holes in the drill bit, and back around the outside wall of the drill pipe. As the mud is forced from the hole, it carries the rock cuttings with it. Again, if the escape route for the pressurized mud should become blocked, the potential for building substantial pressures trapped underground is even greater with the substantially incompressible mud.

Because of the potential environmental hazards that may arise from releasing pressurized fluids underground, such as causing bulging of road surfaces when drilling beneath a roadway, rules and regulations have been, or are now being, promulgated to prohibit such releasing of pressurized fluids in near surface bores. Thus, what is needed is a system whereby pressurized fluid can be circulated therethrough in a closed, fluid-tight arrangement such that no fluids, compressible or incompressible, are released inside a bore being drilled in frangible material that might otherwise create an environmental hazard.

SUMMARY OF THE INVENTION

In accordance with the present invention, a system is provided for drilling a generally horizontal bore through frangible material, such as a rock ledge beneath a roadway. The system includes a barrel mechanism containing a piston mechanism in a cavity thereof. Pressurized fluid is delivered to, and exhausted from, the piston mechanism by a fluid-tight fluid distribution means such that the piston mechanism automatically executes a reciprocal cycle that repeatedly delivers hammering blows to an anvil of a shank of a bit of a driver assembly. A fluid distributor directs the supply fluid and the fluid being exhausted to the walls of the barrel mechanism to thereby reserve the axially situated cavity for the reciprocating motion of the piston mechanism.

The shank has splines that mesh with flutes of a housing of the driver assembly such that the bit rotates with the housing. Protrusions on the distal end of the bit break away pieces of the frangible material and transverse grooves across the face of the bit carry that debris to the periphery of the bit whereat the debris is deposited there behind.

The barrel assembly and driver assembly is encircled by auger sleeves having spiraling flights extending outwardly therefrom. A motor mounted on a driven carriage mounted on a platform rotatingly urges the barrel assembly and bit against the frangible material. A fluid source situated exteriorly to the bore being drilled supplies pressurized fluid to the fluid distribution arrangement that drives the reciprocating motion of the piston means. The pressurized fluid is provided through a swivel arrangement.

The system includes a pushing member attached to the driven carriage such that a casing joint is simultaneously and non-rotatingly installed in the bore as the bore is being drilled. The auger sleeve and associated flighting is dimensioned relative to the inside diameter of the casing joint such that the debris is urged into the spacing between the auger sleeve and the casing joint to be augered away from the interface between the bit and the frangible material being removed and to be deposited exteriorly to the bore.

As the drilling progresses into the frangible, one or more drill/auger stem sections are installed between the motor and the barrel assembly, along with additional casing joints as needed, to drill completely through the frangible material and to simultaneously encase the bore created therethrough, all without exposing the wall of the bore to fluid pressure greater than ambient atmospheric pressure and without using incompressible fluids.

PRINCIPAL OBJECTS AND ADVANTAGES OF THE INVENTION

Principal objects and advantages of the invention include: providing system for drilling a generally horizontal bore through frangible material without exposing the wall of the bore to fluid pressure greater than ambient atmospheric pressure; providing such a system that removes boring debris mechanically; providing such a system that does not use a fluid for flushing purposes; providing such a system that simultaneously installs casing joints in the bore being drilled, providing such a system that uses the casing joints being installed in conjunction with an augering mechanism of the system to mechanically remove drilling debris as the bore is being drilled; and generally providing such a system that is useful, reliable, efficient, and environmentally friendly.

Other objects and advantages of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

Figure 1:
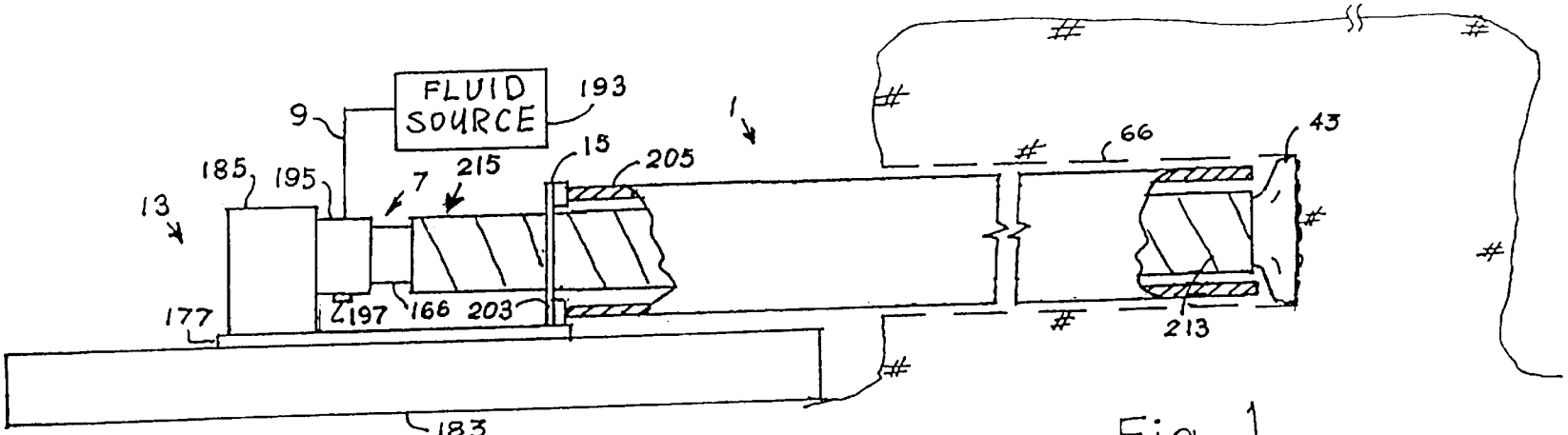
FIG. 1 is a schematic side elevational view of an environmentally friendly horizontal boring system with portions cut away to reveal details thereof, according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to an environmentally friendly horizontal boring system in accordance with the present invention, as shown in FIGS. 1 through 4. The horizontal boring system 1 generally comprises a driver assembly 3, a barrel assembly 5, a coupler assembly 7, a fluid distributing assembly 9, a power assembly 13, a casing installation assembly 15, a debris removal system 17, and a drill/auger stem assembly 23.

The driver assembly 3 includes a bit shank housing 33 and bushing means 35 surrounding a shank 37 of a cutting bit 43. The bit 43 is generally constructed of an appropriate metallic substance designed to withstand the substantial percussion forces applied by the barrel assembly 5 to a generally planar proximal end or anvil 45 of the bit 43, as hereinafter described.

The bit 43 and bit shank housing 33 are configured such that the shank 37 of the bit 43 can be reciprocally displaced longitudinally relative to the bit shank housing 33 within limits as hereinafter described. Further, the shank 37 generally has splines 47 extending radially outwardly therefrom which are configured to be slidably received within mating flutes 53 on the inside surface of the bit shank housing 33 such that when the bit shank housing 33 is caused to rotate about a longitudinal axis as hereinafter described, the bit 43 simultaneously rotates with the bit shank housing 33 while being reciprocally displaced longitudinally.

Mounting of the bit 43 in the bit shank housing 33 generally includes a bearing means 55 to facilitate the reciprocal longitudinal displacement, and sealing means 57, such as O-rings or other suitable arrangement, to provide a fluid-tight seal about the shank 37. The bushing means 35 maintains the anvil 45 of the bit shank 37 in axial alignment with the bit shank housing 33 as the bit 43 undergoes the reciprocal longitudinal displacements.

The leading or distal end 63 of the bit 43 generally has nubs or protrusions 65 extending forwardly therefrom to enhance the rock-breaking forces applied to, and to construct a bore 66 in, the frangible subterranean structure being penetrated by the boring system 1. The bit 43 generally also has one or more grooves 67 extending transversely across the distal end 63 thereof such that as the bit 43 rotates during operation thereof, debris removed from the rock structure being penetrated is caused to migrate generally radially outwardly to a periphery 73 of the bit 43, whereat the debris is deposited rearwardly from the bit 43 for subsequent removal from the bore 66 by the debris removal assembly 17 as hereinafter described.

The bit shank housing 33 has connecting means 75, such as a threaded or other suitable arrangement, configured to connect the driver assembly 3 to the barrel assembly 5. The barrel assembly 5 includes barrel means 77, piston means 83, distributor means 85, and barrel fluid distribution means 86. The barrel means 77 has an axial cylindrically shaped cavity 87 therein. A distal end 89 of the cavity 87 is defined by the anvil 45 of the bit 43. The distributor means 85 is mounted at or near a proximal end of the barrel assembly 5 and defines a proximal end 93 of the cavity 87.

The piston means 83, which is cylindrically shaped and slidably mounted within the cavity 87, has at least one piston fore intake port 95 and at least one piston fore exhaust port 97, each having fluid communication connection to a distal end 103 of the piston means 83 through a piston fore channel 105. The piston means 83 also has at least one piston aft intake port 107 and at least one piston aft exhaust port 113, each having fluid communication capability with a proximal end 115 of the piston means 83 through a piston aft channel 117.

The barrel means 77 generally includes an inner sleeve 123, and an outer sleeve 125 in fluid-tight abutting engagement with the inner sleeve 123. The barrel fluid distribution means 86 generally includes at least one intake passage 127 in fluid communication with and connecting a fluid intake portion 133 of the distributor means 85 to at least one barrel fore intake vent 135 and at least one barrel aft intake vent 137, and at least one exhaust passage 143 in fluid communication with and connecting a fluid exhaust portion 145 of the distributor means 85 to at least one barrel fore exhaust vent 147 and at least one barrel aft exhaust vent 153. If desired, the barrel intake and exhaust passages 127, 143 may be constructed by forming the passages 127, 143 in the outer surface of the inner sleeve 123. It is to be understood that, alternatively, the passages 127, 143 may be formed in the inner surface of the outer sleeve 125, or may be appropriately formed in both the outer surface of the inner sleeve 123 and the inner surface of the outer sleeve 125.

Figure 2:
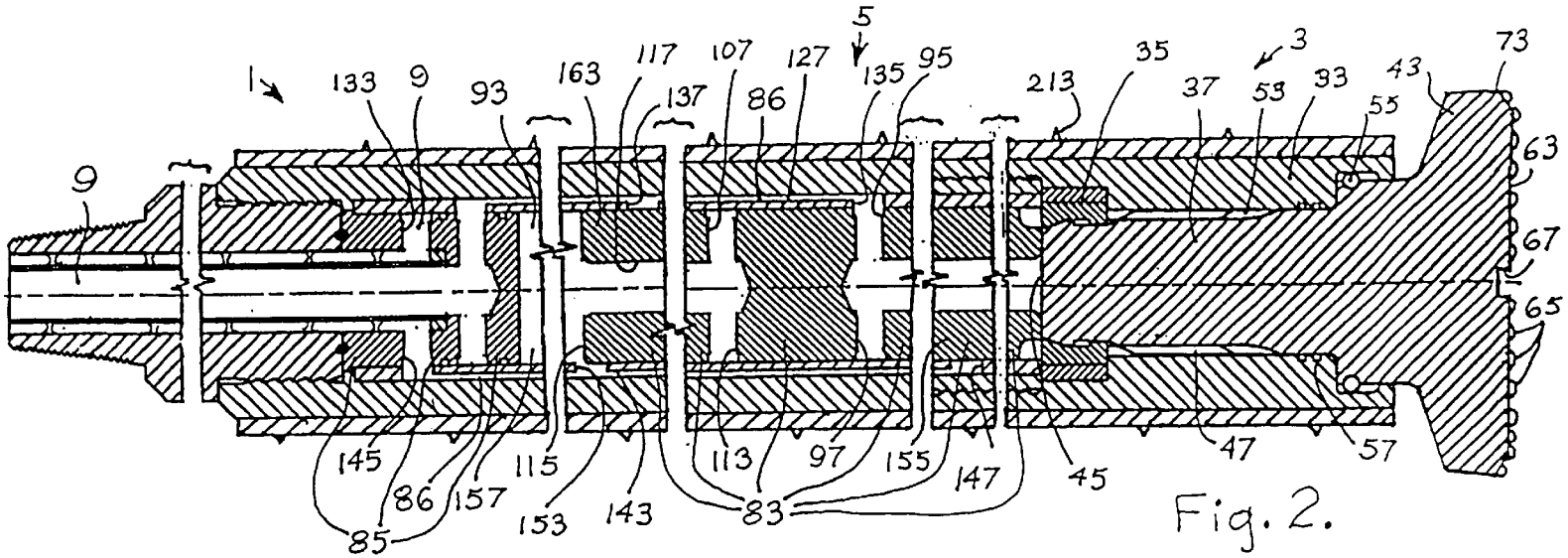
FIG. 2 is an enlarged and fragmentary, axial cross-sectional view of the environmentally friendly horizontal boring system, showing a hammering means thereof in a distal or impact disposition.

The spacings of the ports 95, 97, 107, 113 and the vents 135, 137, 147, 153 are configured such that as the piston means 83 is spaced in a distal-most orientation such that the piston means 83 abuts or is spaced in close proximity to the anvil 45, the at least one piston fore intake port 95 is spaced such that it is in fluid communication with the at least one barrel fore intake vent 135 and the at least one barrel fore exhaust vent 147 is spaced such that it is blocked by a distal portion 155 of the piston means 83 and is not in fluid communication with the at least one piston fore exhaust port 97, as shown in FIG. 2. At the same time, the at least one barrel aft exhaust vent 153 is spaced such that it is in fluid communication with an aft chamber 157 of the cavity 87 operatively formed between the piston means 83 and the distributor means 85, and the at least one barrel aft intake vent 137 is spaced such that it is blocked by a proximal portion 163 of the piston means 83 and is not in fluid communication with the at least one piston aft intake port 107.

Similarly, the spacings of the ports 95, 97, 107, 113 and the vents 135, 137, 147, 153 are configured such that as the piston means 83 is spaced at or near a rear-most or cocked configuration in its reciprocating motion, the at least one piston aft intake port 107 is spaced such that it is in fluid communication with the at least one barrel aft intake vent 137 and the at least one aft barrel exhaust vent 153 is spaced such that it is blocked by the proximal portion 163 of the piston means 83 and is not in fluid communication with the at least one piston aft exhaust port 113, as shown in FIG. 2. At the same time, the at least one barrel fore exhaust vent 147 is spaced such that it is in fluid communication with a fore chamber 165 of the cavity 87 formed between the piston means 83 and the anvil 45, and the at least one barrel fore intake vent 135 is spaced such that it is blocked by the distal portion 155 of the piston means 83 and is not in fluid communication with the at least one piston fore intake port 95.

Sizes and spacings of the ports 95, 97, 107, 113, the vents 135, 137, 147, 153, the aft cavity chamber 157, and the fore cavity chamber 165 are configured to cooperatively and automatically cause and control the reciprocal displacement of the piston means 83 in the barrel means 5.

Figure 3:
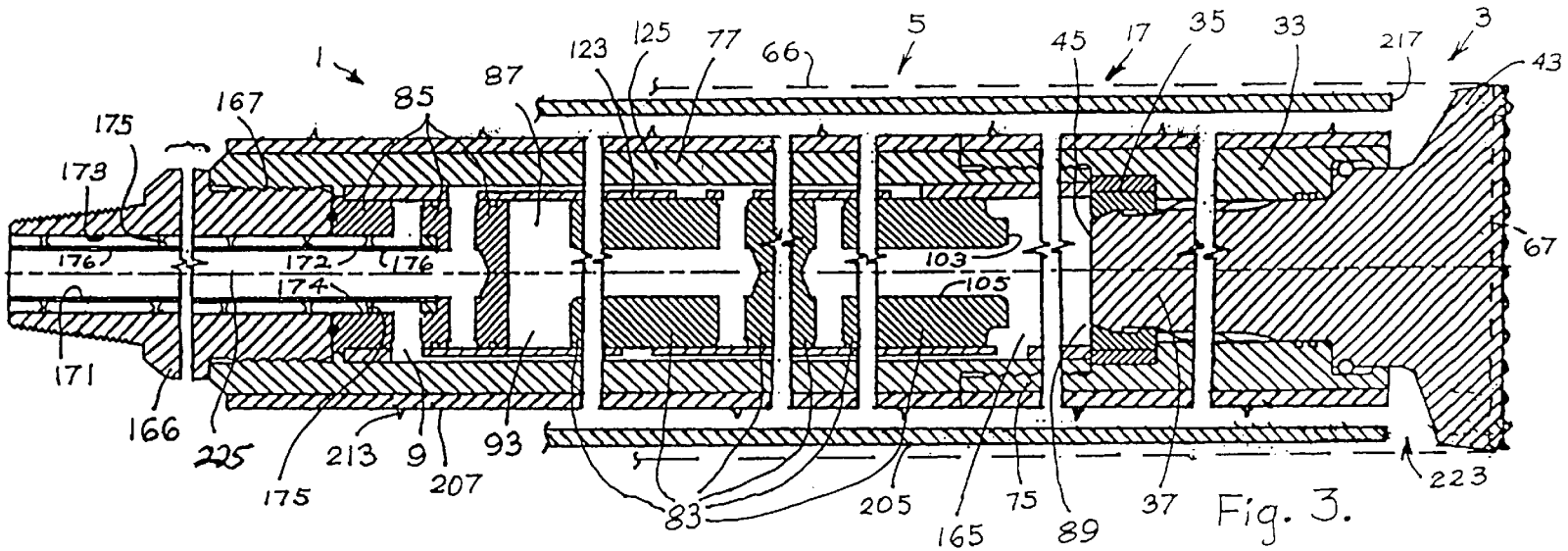
FIG. 3 is an enlarged and fragmentary, axial cross-sectional view of the environmentally friendly horizontal boring system, similar to the view in FIG. 2 but showing the hammering means thereof in a proximal or cocked disposition.

The barrel means 77 is configured to form a fluid-tight connection with an adaptive coupler 166 of the coupler assembly 7, such as by a threaded or other suitable arrangement, as designated by the numeral 167 in FIG. 3. The adaptive coupler 166 has an axially situated intake channel 171 configured to communicate fluid to the intake passage 127 of the barrel means 5 through an intake channel 172 of the distributor means 85, and a concentrically situated exhaust channel 173 configured to receive fluid being exhausted from the exhaust passage 143 of the barrel means 5 through an exhaust channel 174 of the distributor means 85. Webbing 175 or other suitable standoff-type arrangement is provided between a shell 176 that partitions the intake channel 172 from the exhaust channel 173 to maintain a preferred concentric, fluid-tight relationship therebetween in each of the distributor means 85 and the adaptive coupler 166.

The power assembly 13 of the system 1 is generally mounted on a driven carriage 177 which, in turn, is slidably mounted on a supporting platform or frame 183, such as on rails or other suitable arrangement. The power assembly 13 generally includes rotary power means 185, such as a hydraulic motor or other suitable arrangement. The motor 185 is connected through the coupler assembly 7, including the adaptive coupler 166, such that the adaptive coupler 166, the barrel means 5, the driver assembly 3, and drill/auger stem sections 191 (if any, and as hereinafter described) are operatively rotated about a generally horizontal axis.

The power assembly 13 also includes means for powering the piston means 83, such as a fluid source wherein adequate pressurized fluid is provided by a compressor or other suitable means, as schematically indicated by "FLUID SOURCE" designated by the numeral 193 in FIG. 1. The fluid source 193 is connected by the coupler assembly 7 to the distributor intake channel 172 through a swivel mechanism, as known to those having skill in the art and as schematically designated by the numeral 195. The swivel mechanism 195 of the coupler assembly 7 is generally further configured to receive fluid exhausted through the distributor exhaust channel 174 and to exhaust that fluid through an exhaust outlet 197 into the atmosphere or other suitable receptor.

The casing installation assembly 15 includes a pushing member 203 connected to the driven carriage 177. The casing installation assembly 15 is configured, as the driven carriage 177 is driven forwardly to urge the bit 43 farther into the frangible material being bored, to operatively install a casing joint 205 in abutting engagement with the pushing member 203 in the bore 66. The casing joint 205 has an inside diameter greater than the radial dimensions of an auger sleeve 207 as hereinafter described, and an outside diameter smaller than the diameter of the periphery 73 of the bit 43. The pushing member 203 has an open center such that the auger sleeve 207 can freely rotate as the pushing member 203 remains unrotatingly connected to the driven carriage 177. Typically, the casing joint 205 has a length of approximately ten feet. It should be understood, however, that the system 1 is not generally limited to any particular length or diameter of the casing 205.

The debris removal system 17 includes one of the auger sleeves 207 mounted around and connected to the barrel means 5 such that rotation of the barrel means 5 causes simultaneous rotation of the attached auger sleeve 207. Another one of the auger sleeves 207 is mounted around and connected to the bit shank housing 33. The end-to-end auger sleeves 207 of the barrel means 5 and the bit shank housing 33 extend substantially the entire length of the barrel means 5 and the bit shank housing 33, as shown in FIG. 2. The debris removal system 17 also includes auger flighting 213 projecting outwardly from, and spiraling along substantially the entire length of, the respective auger sleeve 207, as indicated by the arrow designated by the numeral 215 in FIG. 1.

The system 1 is configured such that as debris enters the spacing between the casing joint 205 and the auger sleeve 207, the auger flighting 213 augers the debris rearwardly away from the bit 43. The orientation of the auger flighting 213 shown in FIG. 1 would auger the debris away from the bit 43 for an application wherein the motor 185 axially rotates the bit 43 clockwise. For an application wherein the motor 185 rotates the bit counterclockwise, the auger flighting 213 would, of course, have the opposite orientation.

In an application of the present invention, the supporting frame 183 is positioned generally horizontally relative to the frangible material sought to be bored. Various of the basic components of the horizontal boring system 1, such as the driver assembly 3, the barrel means 5, the debris removal system 17, and the coupler assembly 7 are connected together on the supporting frame 183 such that the bit 43 of the driver assembly 3 is appropriately aimed toward the frangible material. One of the casing joints 205 is positioned around the barrel means 5 and the pushing member 203 is adjusted relative to the driven carriage 177 such that a distal end 217 of the casing joint 205 is spaced just behind the bit periphery 73, as shown in FIG. 3.

The power assembly 13, which provides among other things forward displacement of the bit 43, is attached such that the bit 43 will be urged against the material to be removed, and the fluid source 193 is appropriately connected to the barrel means 5 through the swivel mechanism 195 of the coupler assembly 7. The power assembly 13 is then activated to rotationally urge the bit 43 against the frangible material. In addition, the fluid source 193 is activated to drive the piston means 83 to thereby cause the bit 43 to deliver hammering or rock-crushing blows to the frangible material.

The barrel means 5 is designed such that repeated blows are automatically delivered by the piston means 83 to the anvil 45 as follows. As the piston means 83 assumes a distal-most disposition whereat the distal portion 155 of the piston means 83 rests against or is spaced in close proximity to the anvil 45, the fluid causes the piston means 83 to be displaced rearwardly or away from the anvil 45 in the following manner. As pressurized fluid is directed through the intake channel 171 of the adaptive coupler 166, the distributor means 85 diverts that fluid to the intake passage 127. Since the at least one barrel aft intake vent 137 from the intake passage 127 is blocked by the proximal portion 163 of the piston means 83, fluid cannot pass through the vent 137 during that phase of the cycle of the piston means 83. However, the at least one barrel fore intake vent 135 is in fluid communication with the piston fore intake port 95 of the piston means 83. At the same time, the piston fore exhaust port 97 is blocked such that fluid entering through the piston fore intake port 95 cannot escape into the exhaust passage 143 during that phase of the cycle of the piston means 83. As a result, pressurized fluid flows into the piston fore channel 105 forcing the piston means 83 rearwardly away from the anvil 45, thereby operably creating the fore cavity chamber 165 and a physical separation between the piston means 83 and the anvil 45.

As the piston means 83 begins moving rearwardly, the aft cavity chamber 157 is initially in fluid communication with the barrel aft exhaust vent 153 such that fluid exits into the exhaust passage 143 and is exhausted into the atmosphere, or outer suitable arrangement, through the distributor means 85, the coupler assembly 7, the exhaust outlet, etc. As the piston means 83 continues to be displaced rearwardly, the fluid communication connection between the aft cavity chamber 157 and the barrel aft exhaust vent 153, and the fluid communication connection between the barrel fore intake vent 135 and the piston fore intake port 95, are disrupted as indicated in FIG. 3. The sizing of the various components of the barrel means 5, and the relative spacings thereof, are arranged such that the dynamics and magnitude of pressurization of fluid forcing the piston means 83 rearwardly from the anvil 45 is capable of compressing residual fluid in the aft cavity chamber 157, even after closure of the fluid communication connection between the aft cavity chamber 157 and the barrel aft exhaust vent 153 by the proximal portion 163 of the piston means 83, such that sufficient pressurization of the fluid in the aft cavity chamber 157 is created to counter the rapidly decreasing pressure in the fore cavity chamber 165 as the piston means 83 is being forced rearwardly and to provide a fluid cushion whereby the proximal portion 163 of the piston means 83 does not impact with the distributor means 85. As the piston means 83 moves rearwardly such that fluid communication connections between both the intake and exhaust passages 127, 143 and the aft and fore cavity chambers 157, 165 are disrupted, it should be obvious that the fluid pressures in both the aft and fore cavity chambers 157, 165 remain greater than approximately atmospheric pressure but substantially less than the pressure of the fluid provided by the fluid source 193.

As the piston means 83 approaches a rearmost disposition in its reciprocating cycle, the piston aft intake port 107 moves into fluid communication connection with the barrel aft intake vent 137, and the barrel fore exhaust vent 147 moves into fluid communication connection with the fore cavity chamber 165, as shown in FIG. 3. Then, the pressurized fluid in the fore cavity chamber 165 exhausts through the barrel fore exhaust vent 147 into the exhaust passage 143, and pressurized fluid in the intake passage 127 flows into the aft cavity chamber 157 through the piston aft intake port 107 and the piston aft channel 117. As a result, the piston means 83 is caused to accelerate forwardly toward the anvil 45.

As the piston means 83 continues to be displaced distally or forwardly, the fluid communication connection between the fore cavity chamber 165 and the barrel fore exhaust vent 147, and the fluid communication connection between the barrel aft intake vent 137 and the piston aft intake port 107 are disrupted. Again, the sizing of the various components of the barrel means 5, and the relative spacings thereof, are arranged such that the dynamics and magnitude of pressurization of fluid forcing the piston means 83 forwardly toward the anvil 45 is capable of compressing the residual fluid in the fore cavity chamber 165 into the piston fore channel 105, even after closure of the fluid communication connection between the fore cavity chamber 165 and the barrel fore exhaust vent 147 by the distal portion 155 of the piston means 83, such that the remaining pressure, although rapidly decreasing, in the aft cavity chamber 157 as the piston means 83 is being forced forwardly and the momentum of the piston means 83 is sufficient to provide desired impact forces between the distal portion 155 of the piston means 83 and the anvil 45 whereby rock-shattering forces are conveyed to the interface between the distal end 63 of the bit 43 and the frangible material.

The fluid compressed into the piston fore channel 105 during the forward stroke of the cycle of the piston means 83, which pressure is substantially less than the pressure of the fluid contained in the intake passage 127, provides a "jump start" on the next cycle of the piston means 83. In addition, as the piston means 83 approaches impact with the anvil 45, the piston fore intake port 95 moves into fluid communication connection with the barrel fore intake vent 135, and the aft cavity chamber 157 moves into fluid communication connection with the barrel aft exhaust vent 153, as shown in FIG. 2. Then, the pressurized fluid in the aft cavity chamber 157 exhausts through the barrel aft exhaust vent 153 into the exhaust passage 143, and pressurized fluid in the intake passage 127 flows into the piston fore channel 105 through the piston fore intake port 95. As a result, the piston means 83 is caused to accelerate rearwardly away from the anvil 45, thereby repeating the cycle.

As the frangible material is chipped away by the distal end 63 of the bit 43 and the debris thereof displaced from the interface between the bit 43 by the grooves 67, the debris is disposed rearwardly around the peripheral edge 73 of the bit 43 in a region in front of the casing joint 205, as indicated by the arrow designated by the numeral 223 in FIG. 3. As the debris being removed from the interface starts to accumulate in the region 223, the debris is urged into the spacing between the casing joint 205 and the auger sleeve 207. Radial dimensions of the rotating auger sleeve 207 with the auger flighting 213 relative to the dimensions of the non-rotating casing joint 205 are configured such that the frangible material debris is augered rearwardly from the region 223 by the spiraling motion of the flighting 213 such that the debris is conveyed to just distally from the pushing member 203 and exteriorly clear of the bore 66.

It should now be obvious that the present invention clearly provides an environmentally friendly attribute in that the operable fluid is compressible, and pressurization thereof occurs exteriorly away from the bore 66 being constructed through the frangible material. Further, the pressurized fluid is conveyed both to and from the barrel means 5 in a closed, self-contained fluid-tight distribution system. Additionally, after traversing the closed fluid distribution system, the exhausted pressurized fluid is exhausted into the ambient atmosphere or other suitable receptor, again entirely away from the bore 66 being constructed through the frangible material. Also, the debris is removed mechanically without the need for a substantially incompressible flushing substance, such as "mud", as commonly used in prior art equipment.

Figure 4:
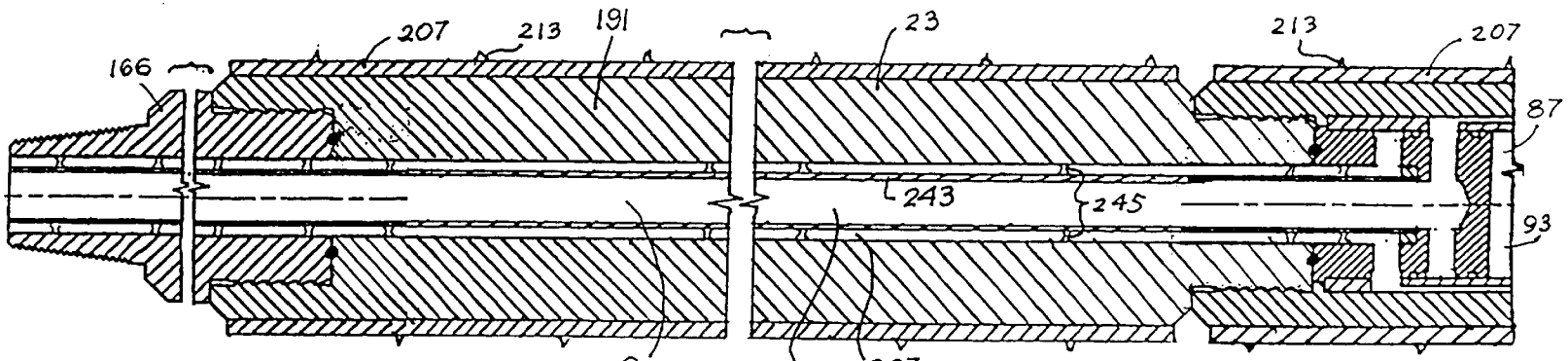
FIG. 4 is an enlarged and fragmentary, axial cross-sectional view of the environmentally friendly horizontal boring system, showing a drill/auger stem section thereof, according to the present invention.

After a substantial portion of the barrel means 5 has penetrated into the frangible material, the rotational and forward displacement of the bit 43 is temporarily paused while the adaptive coupler 166 is disconnected from the barrel means 5. Then, one of the drill/auger stem sections 191 is appropriately positioned between, and connected to each of, the proximal end of the barrel means 5 and the adaptive coupler 166, as shown in FIG. 4.

In addition, another casing joint 205 is positioned between the initial casing joint 205 and the pushing member 203 such that the newly added casing joint 205 will be urged into the bore 66 alongside the drill/auger stem section 191. The power assembly 13 is then reactivated to rotatingly urge the driver assembly 3, the barrel means 5, the drill/auger stem section 191, etc., and to non-rotatingly urge the newly added casing joint 205 in abutting end-to-end engagement with the initial casing joint 205, in unison toward the frangible material to thereby continue environmentally friendly drilling therethrough as the self-contained fluid-tight fluid distribution system maintains the pressurized fluid well away from the wall of the bore 66 through the frangible material.

It is to be understood that additional drill/auger stem sections 191 can be added to the proximal end of the last preceding drill/auger stem section 191 as needed to completely penetrate the frangible material, such as beneath a roadway for example, such that the drill/auger stem sections 191 cooperatively perform their design functions in tandem.

It is to be understood that each drill/auger stem section 191 has an axially situated intake channel 225, connecting distal and proximal ends thereof in fluid communication, configured to form a fluid-tight connection with the intake channel 171 of the adaptive coupler 166, the intake channel 172 of the distributor means 85, and/or the intake channel 225 of another drill/auger stem section 191, as appropriate. Each drill/auger stem section 191 also has a concentrically situated exhaust channel 227, connecting distal and proximal ends thereof in fluid communication, configured to form a fluid-tight connection with the exhaust channel 173 of the adaptive coupler 166, the exhaust channel 174 of the distributor means 85, and/or the exhaust channel 227 of another drill/auger stem 191. as appropriate. It is also to be understood that each of the drill-auger stem sections 191 includes an auger sleeve 207 with spiral flighting 213 such that components thereof rotate together as a unit as hereinbefore described. A shell 243 partitions the intake channel 225 from the exhaust channel 227, with webbing 245 therebetween to maintain the preferred concentric relationship thereof.

Upon complete penetration of the frangible material and the distal end of the distal-most casing joint 205 is positioned as desired relative to the distal opening of the bore 66, further urging of the casing joint or joints 205 is terminated. However, the driver assembly 3 must be extended sufficiently beyond the casing joints 205 such that the driver assembly 3 can be dismantled from the barrel means 5. To accomplish that objective, the driver assembly 3 may be extended beyond the casing joints 205 by removing the pushing member 203, then distally urging the string of drill/auger stem sections 191 as needed. Adding another drill/auger stem section 191 to the string may be required in order to obtain the clearance desired. After removing the driver assembly 3, the barrel means 5 and the drill/auger stem sections 191 may be removed from either end of the bore 66.

Whereas the present invention has been described in relation to the drawings attached hereto, it should be understood that other and further modifications, apart from those shown or suggested herein, may be made within the spirit and scope of this invention.

What is claimed and desired to be covered by Letters Patent is as follows:

1. An apparatus for drilling a generally horizontal bore through frangible material, comprising:

(a) a barrel assembly including a piston mechanism, fluid intake and fluid exhaust ports, and a barrel fluid distribution system having intake and exhaust passages configured to receive and exhaust an operating fluid for operatively causing, in conjunction with said ports, reciprocal displacement of said piston mechanism;

(b) an adaptive coupler connected in a fluid-tight arrangement to said fluid distribution system at one end of said barrel assembly, said adaptive coupler configured to deliver the operating fluid from a source exterior to said bore to said barrel fluid distribution system, and to exhaust, exteriorly from the bore, the operating fluid from said barrel fluid distribution system; and (c) a driver assembly connected to the other end of said barrel assembly, said driver assembly including an anvil and bit shank assembly configured to receive impact forces from said piston mechanism and to convey said impact forces to an interface between the frangible material and said driver assembly.

2. An apparatus according to claim 1, wherein said barrel assembly comprises an inner barrel and an outer barrel coaxial therewith, said inner barrel having intake and exhaust vents configured to operatively and respectively connect said intake and exhaust passages to said intake and exhaust ports of said piston mechanism.

3. An apparatus according to claim 1, wherein said operating fluid comprises compressed air.

4. An apparatus according to claim 1, wherein said barrel assembly includes an inner barrel and an outer barrel coaxial therewith, said barrel fluid distribution system including a fluid distributor disposed at a proximal end of said barrel assembly, said inner barrel having intake vent means and exhaust vent means communicating with said operating fluid through said fluid distribution system, said inner barrel in conjunction with said anvil and said piston mechanism operatively defining a fore chamber therebetween, and said inner barrel in conjunction with said distributor and said piston mechanism operatively defining an aft chamber therebetween.

5. An system for drilling a generally horizontal bore through a frangible material such as under a roadway, said system comprising:

(a) a barrel assembly including cylindrical sleeve means having an axial cavity, piston means slidably displaceably mounted in said cavity;

(b) fluid distribution means configured to operatively deliver fluid to and receive exhausted fluid from said piston means wherein said distribution means and said piston means are configured to operatively cause said piston means to automatically execute reciprocal displacements in said cavity;

(c) a coupler assembly configured to receive fluid from a fluid source exteriorly of the bore and to deliver the received fluid to and received the exhausted fluid from said fluid distribution means, said coupler assembly configured to release said received exhausted fluid exteriorly of the bore;

(d) a driver assembly connected to said barrel assembly, said driver assembly configured to operatively receive impact forces from said piston means as said piston means execute said reciprocal displacements and to deliver said impact forces to a selected portion of the frangible material;

(e) supporting means configured to support said coupler assembly, said barrel assembly, and said driver assembly;

(f) a power assembly mounted on said supporting means and configured to operatively and rotatingly distally urge said barrel means and said driver assembly about longitudinal axes thereof to thereby breakup said selected portion of frangible material into debris to construct the bore;

(g) debris removal means configured to operatively and mechanically remove the debris from the bore;

(h) at least one drill stem section connected between said coupler assembly and said barrel assembly;

(i) said fluid distribution means is further configured to operatively deliver fluid to and receive exhausted fluid from said piston means longitudinally through said at least one drill stem section; and wherein said fluid distribution means through said at least one drill stem section includes a cylindrically shaped axial intake channel and an annularly shaped exhaust channel concentrically disposed about said intake channel.

6. A system according to claim 5, wherein said fluid distribution means includes at least one intake passage and at least one exhaust passage formed in said cylindrical sleeve means.

7. A system according to claim 6, wherein said fluid distribution means further includes a fluid distributor having an intake channel and an exhaust channel connected to said coupler assembly, wherein said intake channel is configured to deliver fluid to said at least one intake passage and said exhaust channel is configured to receive fluid being exhausted from said at least one exhaust passage.

8. A system according to claim 7, wherein said intake channel is cylindrically shaped with an axis thereof aligned with said axial cavity and said exhaust channel is annularly shaped and concentrically disposed about said intake channel.

9. A system according to claim 5, wherein said supporting means includes a driven platform upon which said coupler assembly, said barrel assembly, said driver assembly, and said power assembly are mounted.

10. A system according to claim 9, further including a pushing member mounted on said driven platform, said pushing member configured to non-rotatingly and simultaneously install casing joints in the bore as the bore is being drilled.

11. A system according to claim 10, wherein said debris removal system includes at least one auger sleeve secured to said driver assembly and said barrel assembly, said at least one auger sleeve having flighting configured to convey the debris distally from the driver assembly as said at least one auger sleeve is rotatably driven by said power assembly.

12. A system according to claim 11, wherein said debris removal system is configured to remove the debris from the bore by mechanically conveying the debris distally from the driver assembly between said at least one auger sleeve and the casing joint.

13. A system according to claim 5, including an auger sleeve secured to each said at least one drill stem section, said auger sleeve having flighting configured to distally convey the debris as the auger sleeve is rotatably driven by said power assembly.

* * * * *